US005660394A

United States Patent [19]

Takemoto et al.

[11] Patent Number: 5,660,394

[45] Date of Patent: Aug. 26, 1997

[54] GAMING MACHINE ISLAND AND MONEY CHANGING SYSTEM

[75] Inventors: Takatoshi Takemoto; Koichi Tsubota; Koji Yanagisawa, all of Tokyo, Japan

[73] Assignee: Kabushiki Kaisha Ace Denken, Tokyo, Japan

[21] Appl. No.: 505,331

[22] PCT Filed: Dec. 17, 1993

[86] PCT No.: PCT/JP93/01834

§ 371 Date: Aug. 17, 1995

§ 102(e) Date: Aug. 17, 1995

[87] PCT Pub. No.: WO94/19077

PCT Pub. Date: Sep. 1, 1994

[30] Foreign Application Priority Data

Feb. 17, 1993 [JP] Japan ..... 5-27741

[51] Int. Cl.[6] ..... A63F 9/00

[52] U.S. Cl. ..... 273/309; 194/353

[58] Field of Search ..... 273/309, 121 B; 194/353

[56] References Cited

FOREIGN PATENT DOCUMENTS

| | | |
|---|---|---|
| 0 362 480 | 6/1989 | European Pat. Off. . |
| 60-3089 | 1/1985 | Japan . |
| 62-32834 | 7/1987 | Japan . |
| 1-159647 | 11/1989 | Japan . |
| 4-79975 | 3/1992 | Japan . |
| 2 246 007 | 7/1990 | United Kingdom . |

*Primary Examiner*—William H. Grieb
*Attorney, Agent, or Firm*—Seed and Berry LLP

[57] ABSTRACT

A gaming machine island A comprising gaming machines 1 for players to play games with game play media and for paying out game play media to players as a prize, a counter B for counting the number of game play media used at the gaming machines 1, and a money changing machine C for changing a bill or coin into bills or coins of a smaller denomination. The money changing machine C is placed adjoining the counter B.

9 Claims, 9 Drawing Sheets

GAMING MACHINE ISLAND AND MONEY CHANGING SYSTEM

TECHNICAL FIELD

This invention relates to a money changing machine attachment system for a gaming machine island for placing a money changing machine in the middle of the gaming machine island.

TECHNICAL BACKGROUND

Hitherto, a counter has been placed in the middle of a gaming machine island containing a large number of gaming machines such as pachinko ball machines (Japanese pinball machines) and ball lending machines (which may be omitted). A bill changing machine has often been placed on the ends of a gaming machine island or provided independently of the gaming machine island.

Generally, gaming machines are managed for each gaming machine island. However, if a bill changing machine is placed independently of the gaming machine island as described above, there is a high possibility that the player changing a bill at the bill changing machine may play games at another gaming machine island. As a result, accurate data for each gaming machine island cannot be obtained.

Each gaming machine island lacks appeal and convenience attractive to players, thus failing to catch valued players.

DISCLOSURE OF INVENTION

It is therefore one object of the invention to provide a gaming machine island having a structure enabling accurate data collection for each gaming machine island.

It is another object of the invention to provide a money changing system and a money changing machine attachment system for enabling a money changing machine to be placed in a gaming machine island or adjoining a counter.

To these ends, according to a first form of the invention, there is provided a gaming machine island comprising gaming machines for players to play games with game play media and for paying out game play media to players as a prize, a counter for counting the number of game play media input from an outside, and a money changing machine for changing a bill or coin into bills or coins of a smaller denomination, the money changing machine having a transverse position placed adjoining the counter.

In this case, the counter is preferably installed substantially at the center of the gaming machine island.

Preferably, the gaming machine island further includes a storage section for storing bills or coins and means for transporting the bills or coins between the storage section and the money changing machine. Further, the gaming machine island may include a game play media lending machine for receiving cash from players and lending game play media to them and the transport means may also transport currency received at the game play media lending machine to the storage section. Preferably, the storage section is installed at an end position of the gaming machine island.

According to a second form of the invention, there is provided a money changing system attached to a gaming machine island comprising a plurality of gaming machines for players to play games with game play media and a counter for counting the number of game play media input from the outside, the money changing system comprising a stacker being placed at an end position of the gaming machine island for storing bills or coins, a money changing machine having a transverse position placed adjoining the counter for changing a bill or coin into bills or coins of a smaller denomination, and a transporter for transporting bills or coins between the money changing machine and the stacker.

According to a third form of the invention, there is provided a money changing system applied to a gaming machine island comprising a plurality of gaming machines for players to play games with game play media, a counter for counting the number of game play media input from the outside, and a game play media lending machine for lending the game play media to players in exchange for currency, the money changing system comprising a stacker being placed at an end position of the gaming machine island for storing bills or coins, a money changing machine having a transverse position placed adjoining the counter for changing a bill or coin into bills or coins of a smaller denomination, and a transporter for transporting bills or coins, the transporter comprising a main transport passage formed like a loop with the stacker as start and end points, a first branch transport passage formed between a midway point of the main transport passage and the money changing machine, a second branch transport passage formed between the game play media lending machine and a midway point of the main transport passage, and a switch for switching a currency transport path at a branch point between the first branch transport passage and the main transport passage.

In this case, the stacker preferably comprises a reserve chamber for storing reserved bills or coins and a collection chamber for storing bills or coins carried by the transporter and the transporter transports the bills or coins in the reserve chamber to the money changing machine and also transports bills or coins input to the money changing machine to the collection chamber.

Further, the transporter preferably includes a third branch transport passage for transporting the bills or coins stored in the collection chamber to the money changing machine.

Thus, in the invention, the counter and the money changing machine are transversely placed near the middle of the gaming machine island, so that players see the counter while changing money. At that time, if another player counts a large number of discharged game play media, the player changing money feels that he or she has a chance to win a large number of game play media from every gaming machine in the gaming machine island. As a result, the percentage of players playing a game in the gaming machine island where the players changed money is increased, and efficient management in gaming machine island units containing money changers can be accomplished.

Thousand-yen bills can be circulated between the collection chamber of the stacker and the money changing machine for effective use of the bills. The money changing machine can be replenished with thousand-yen bills promptly. Therefore, labor required for maintenance of the money changing machines, etc., can be reduced.

BEST MODE FOR CARRYING OUT THE INVENTION

A first embodiment of the invention will be discussed with reference to FIGS. 1 to 10.

Figure 1:
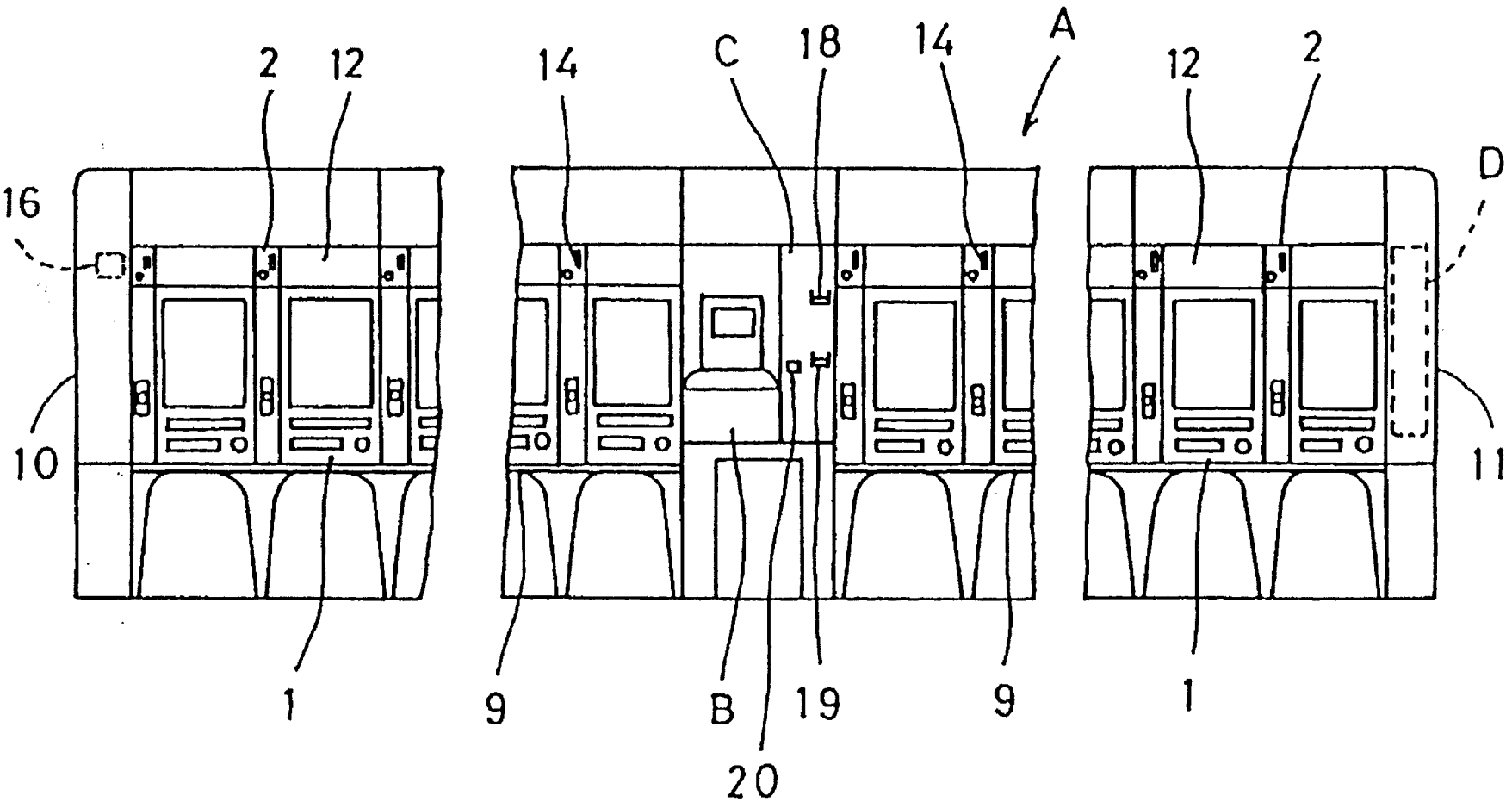
FIG. 1 is a drawing showing one side of gaming machine island A according to a first embodiment of the invention.

FIG. 1 is a schematic drawing of gaming machine island A viewed from one side thereof.

Figure 2:
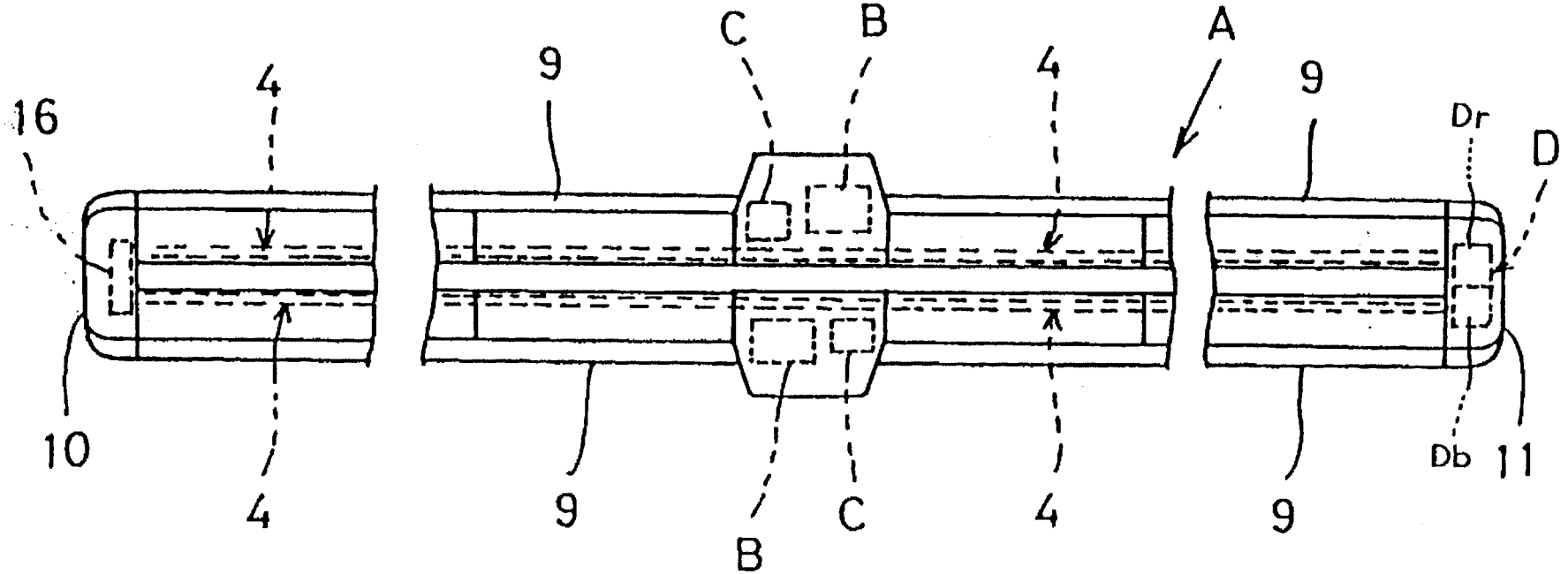
FIG. 2 is a plan view, partially omitted, of the gaming machine island A.

The gaming machine island A comprises an alternating pattern of pachinko ball machines 1 and ball lending machines 2 placed on two parallel top boards 9 and 9 located at a predetermined height (see FIG. 2). The pachinko ball machines 1 and the ball lending machines 2 on one row and those on another row are placed back to back so that they face players on each row. Further, counters B and money changing machines C are placed in the middle of the gaming machine island A and island decorations 10 and 11 are placed on both ends thereof.

Bill transport passages 4 are placed inside upper curtain boards 12 located above the pachinko ball machines 1, as shown in FIG. 2. In the embodiment, two bill transport passages 4 and 4 extend in parallel with each other and are directed in opposite directions to each other (denoted by arrows in FIG. 3). The bill transport passages 4 will be discussed in detail with reference to FIGS. 3 and 4.

Figure 3:
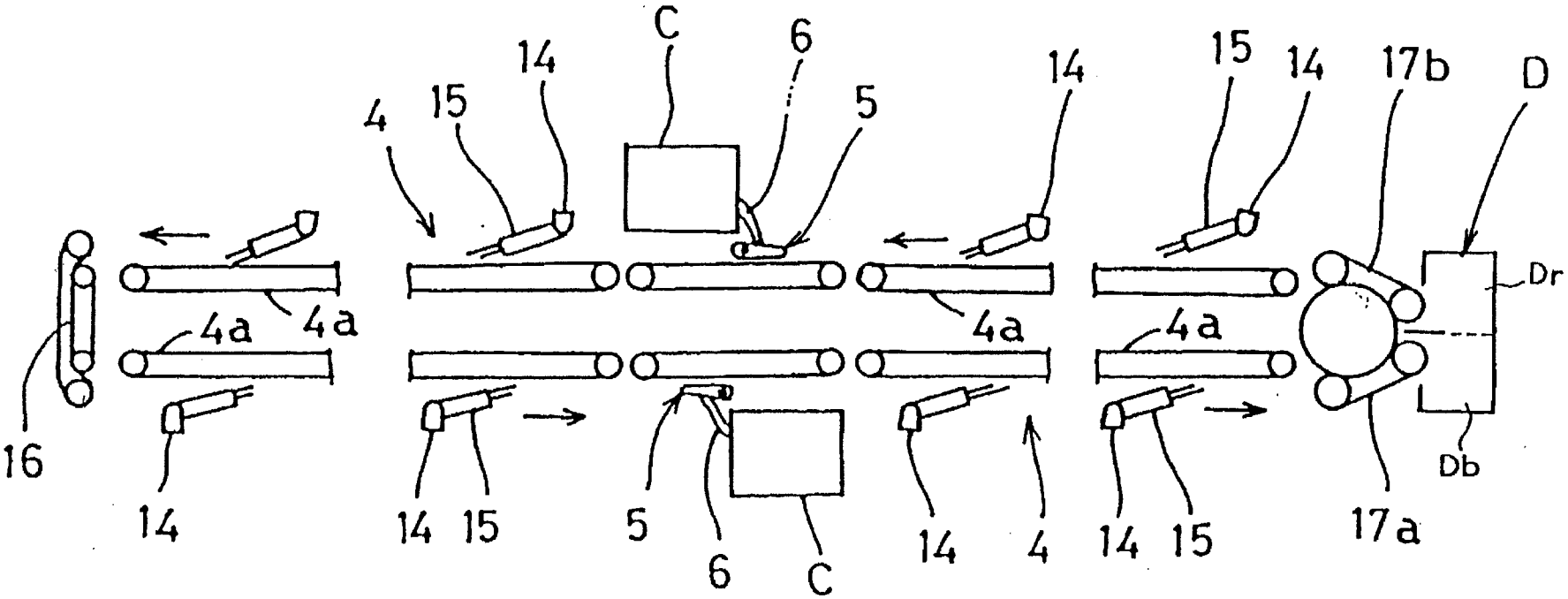
FIG. 3 is a plan view showing bill transport passages 4, a bypass 6, and a switch guide valve 5.

The island decoration 11 contains a stacker D for storing thousand-yen bills 3, a carrying-in belt 17*a*, and a carrying-out belt 17*b* (see FIGS. 2 and 3).

The stacker D is distinctly divided into a section for storing thousand-yen bills reserved for change, which will be hereinafter referred to as a "reserve chamber," Dr and a section for storing thousand-yen bills inserted through the ball lending machines 2, which will be hereinafter be referred to as a "collection chamber," Db; the two are not mixed.

In FIG. 3, the carrying-out belt 17*b* is provided to carry out thousand-yen bills provided in the reserve chamber Dr of the stacker D to the beginning of the transport passage 4 (described below). On the other hand, the carrying-in belt 17*a* is provided to carry thousand-yen bills inserted through the ball lending machines 2 and transported on the transport passage 4 in the collection chamber Db of the stacker D.

The island decoration 10 contains a relay transport passage 16 (see FIGS. 2 and 3) for relaying bills from one bill transport passage 4 to the other, which is the same as the transport passage 4 in basic structure. That is, thousand-yen bills transported on one bill transport passage 4 to the termination thereof are transported through the relay transport passage 16 to the beginning of the other bill transport passage 4.

The money changing machine C is used to change a ten-thousand-yen or five-thousand-yen bill into thousand-yen bills or coins and has a ten-thousand-yen and five-thousand-yen bill slot 18, a thousand-yen-bill dispensing port 19, a coin dispensing port 20, etc., (see FIG. 1). The money changing machine C is formed with a thousand-yen bill inlet 21 on the upper side (see FIG. 6). A bypass 6 is provided between the inlet 21 and the transport passage 4. Thousand-yen bills transported on the transport passage 4 are taken through the bypass 6 into the inlet 21, namely, the money changing machine C.

A switch guide valve 5 is installed at a branch between the transport passage 4 and the bypass 6. The transport path can be changed by operating the switch guide valve 5 for sending thousand-yen bills to the target money changing machine C. The switch guide valve 5 will be discussed in detail later.

The ball lending machine 2 is provided to lend balls to players in exchange for cash. A transport passage provided with a bill validator 15 (Note: The transport passage is a "first branch transport passage" in the claims) is located between the ball lending machine 2 and the transport passage 4. Thousand-yen bills input to the ball lending machine 2 are passed through the transport passage and placed on the transport passage 4 for transporting to the stacker D.

Figure 4:
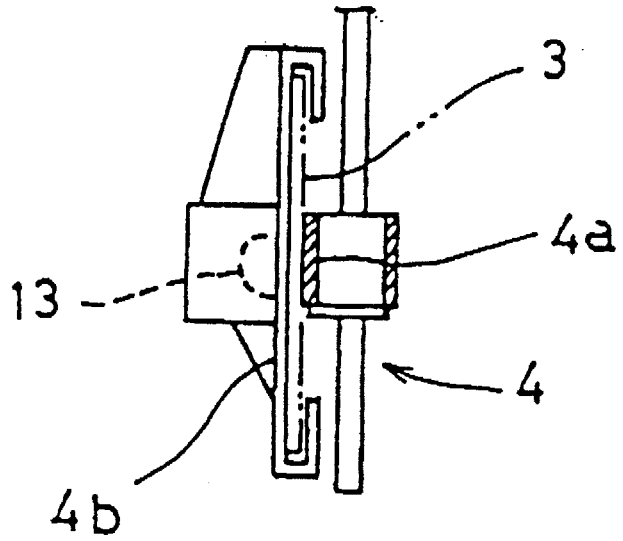
FIG. 4 is a sectional view of the bill transport passage 4.
Figure 5:
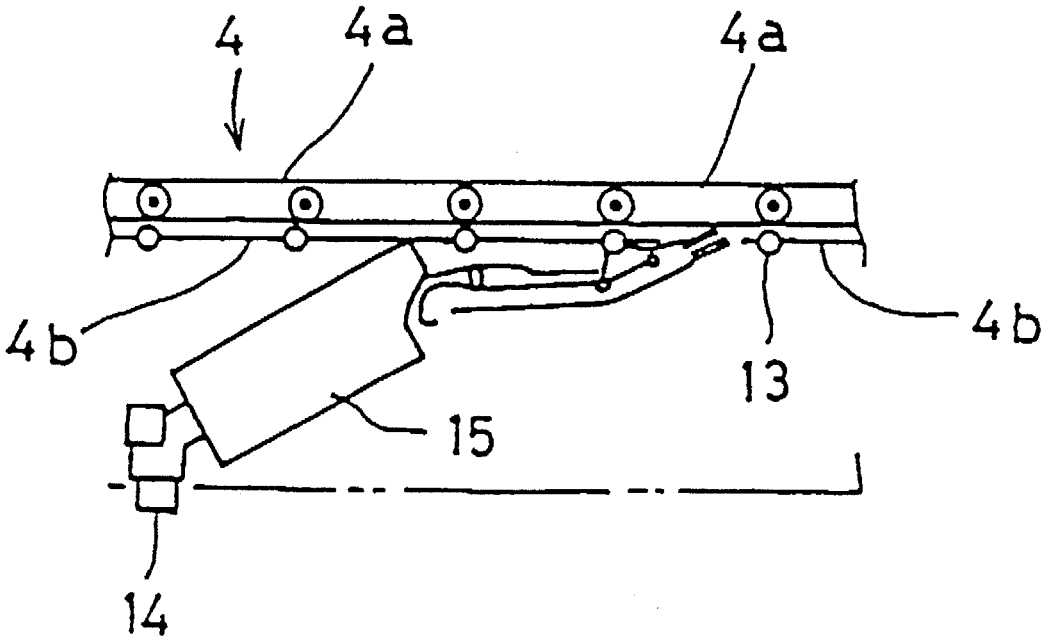
FIG. 5 is a partially enlarged plan view of the bill transport passage 4.

Next, the bill transport passages 4 will be discussed in detail with reference to FIGS. 3 to 5. As shown in FIGS. 3 to 5, the bill transport passage 4 transports a thousand-yen bill 3 put between a transport belt 4*a* and a holder 4*b* provided with holding balls 13.

As shown in FIG. 3, the transport belt 4*a* provides an endless track placed at each point along the transport path, and rams by itself under the action of a motor, etc., (not shown).

As shown in FIGS. 4 and 5, the holder 4*b* is spaced from the transport belt 4*a* at a predetermined interval at the outer position of the endless track of the transport belt 4*a*. The hold balls 13 are attached to points of the holder 4*b* at predetermined intervals. To hold a thousand-yen bill, it is sandwiched between the holding ball 13 and the transport belt 4*a*. In this condition, the thousand-yen bill is held upright with its long side directed ahead (the bill face is contained in the vertical plane). The thousand-yen bill thus held is moved (transported) by means of the transport belt 4*a* which turns. The holder 4*b* has cuts at each point and the thousand-yen bill is entered between the transport belt 4*a* and the holder 4*b* through the cut.

The directions in which thousand-yen bills are transported on the bill transport passages 4 and 4 are opposite to each other (denoted by arrows in FIG. 3), and the thousand-yen bills are transferred between both the transport passages 4 and 4 via the relay transport passage 16.

Next, the structure of the switch guide valve 5 will be discussed with reference to FIGS. 6 and 7. The switch guide valve 5 consists essentially of four guide plates 5*a*, a shaft pipe 22, a vertical shaft 23, and a solenoid 9.

Figure 7:
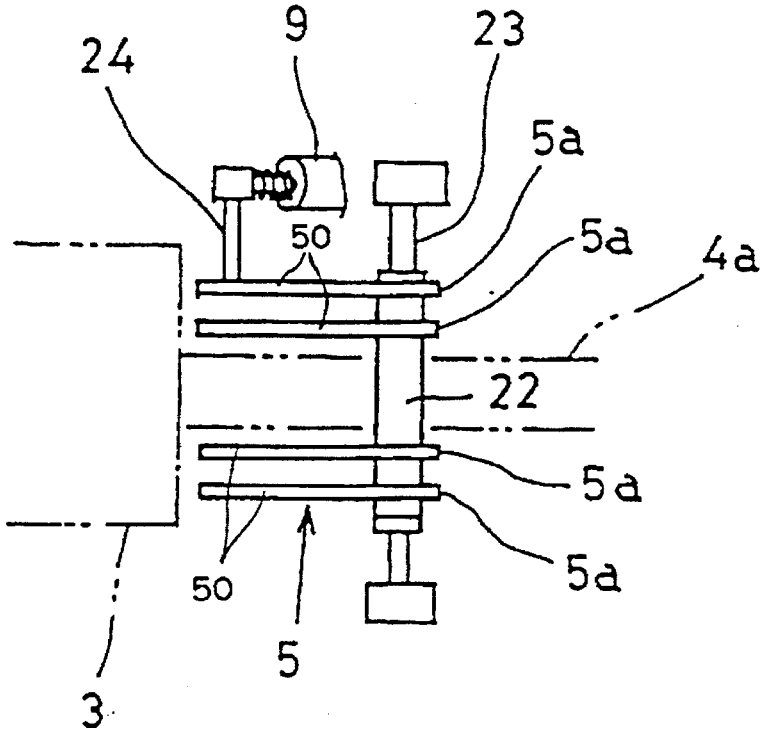
FIG. 7 is a side view showing details of the switch guide valve 5.
Figure 8:
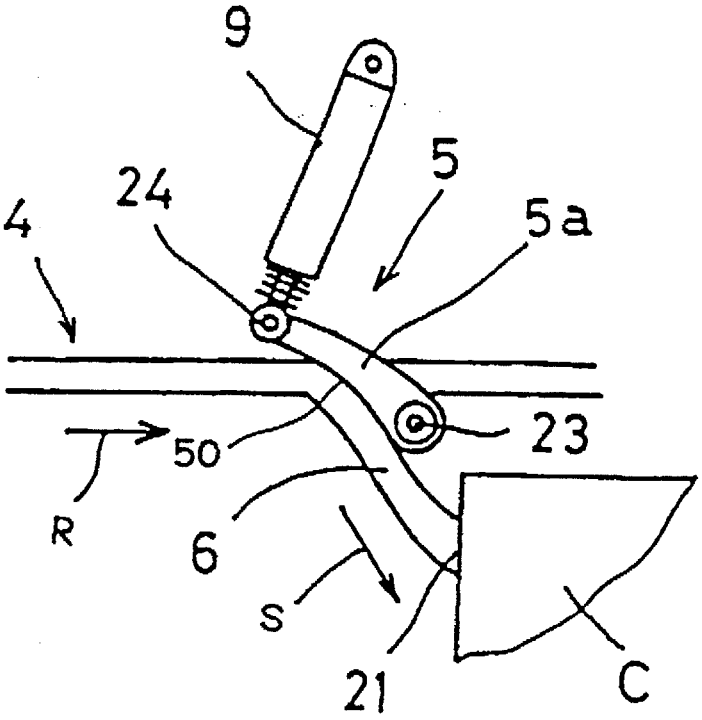
FIG. 8 is a plan view showing an operation state of the switch guide valve 5 for supplying thousand-yen bills to a money changing machine C.

As shown in FIG. 7, the four guide plates 5*a* having circular arcs 50 are arranged in parallel with each other, each having one side fixed to the shaft pipe 22, which is placed contiguously with the bill transport passage 4. The fixed vertical shaft 23 is pivotally fitted into the shaft pipe 22.

Figure 6:
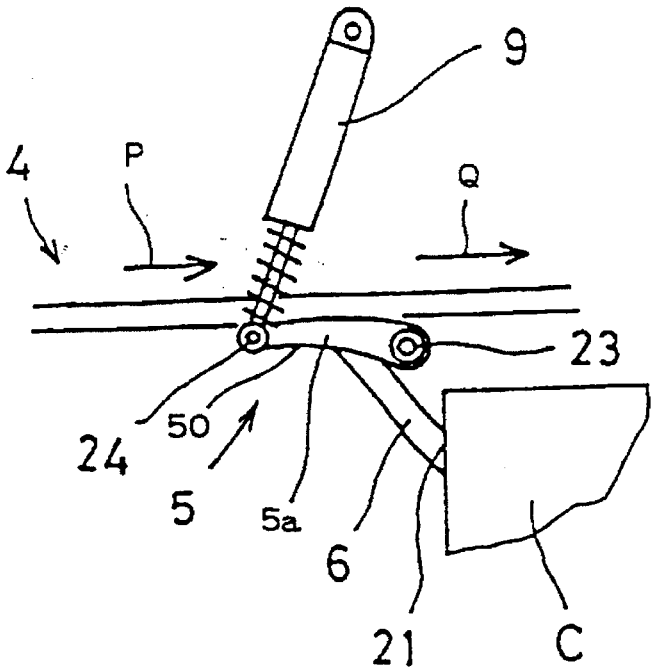
FIG. 6 is a plan view showing details of the switch guide valve 5.
Figure 9:
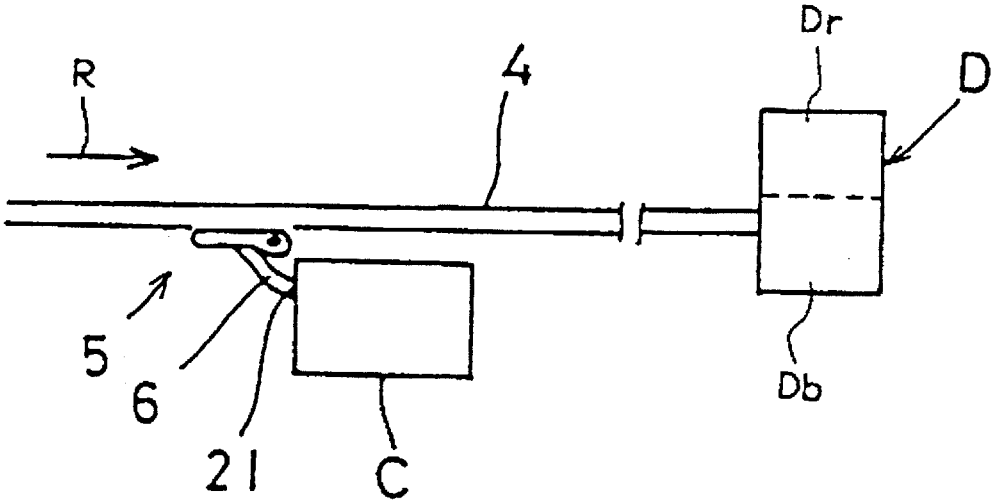
FIG. 9 is a plan view showing a transport path for sending thousand-yen bills to a stacker D.
Figure 10:
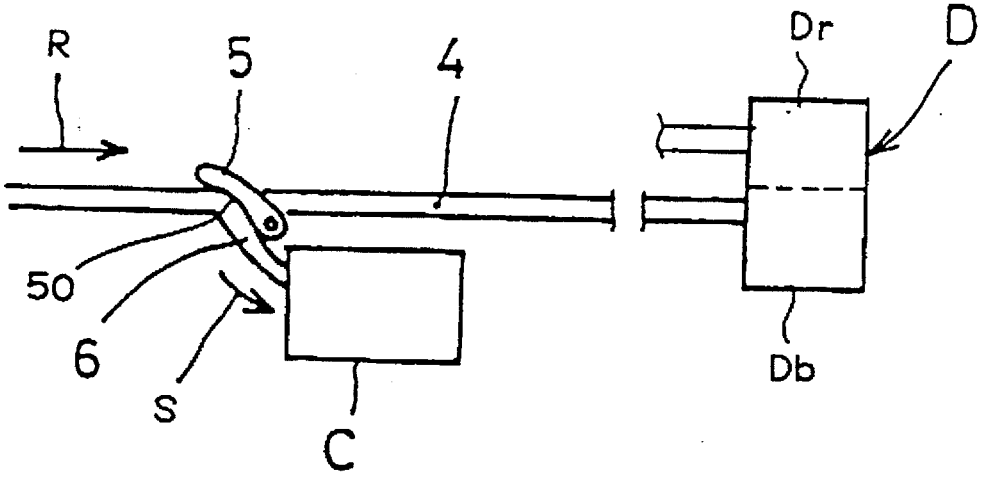
FIG. 10 is a plan view showing a transport path for supplying thousand-yen bills to the money changing machine C.

The top guide plate 5*a* has the other end formed with a pin 24, which is linked with the tip of the solenoid 9 excited and expanding or contracting in response to a signal from the money changing machine C (see FIG. 6). Thus, the guide plate 5*a* pivots on the vertical shaft 23 with expansion or contraction of the solenoid 9. When the solenoid 9 contracts (see FIGS. 8 and 10), the guide plate 5*a* has the circular arc 50 for shutting off the bill transport passage 4, defining a transport passage smoothly connecting the upstream portion from the shutoff part of the bill transport passage 4 and the bypass 6. Therefore, in this condition, thousand-yen bills are transported along the path indicated by arrows R and S in FIG. 8. On the other hand, when the solenoid 9 expands (see FIGS. 6 and 9), the guide plate 5*a* does not interfere with the bill transport passage 4. Therefore, in this condition, thousand-yen bills are transported along the path indicated by arrows P and Q in FIG. 6. FIGS. 9 and 10 omit the solenoid 9, etc.

In operation, when a player inserts a thousand-yen bill into the bill slot 14 of the ball lending machine 2 (see FIG. 1) and specifies the amount of money spent for balls, pachinko balls equivalent to the specified amount are lent to the player. On the other hand, the validity of the inserted thousand-yen bill 3 is determined by the bill validator 15, then the thousand-yen bill 3 is transported on the bill transport passage 4 to the collection chamber Db of the stacker D for storage.

If the player inserts a ten-thousand-yen bill, etc., into the money changing machine C for changing the bill into thousand-yen bills, the ten-thousand-yen bill is stored in the money changing machine C. Thousand-yen bills for change, stored in the money changing machine C, are dispensed. If a low thousand-yen bill condition for change develops in the money changing machine C, the money changing machine C is replenished with thousand-yen bills from the stacker D. The transport belt 17*b*, the bill transport passage 4, and the like are started for carrying out a predetermined number of thousand-yen bills from the reserve chamber Dr of the stacker D. In this case, the thousand-yen bill transport passage is directed toward the bypass 6, namely, the money changing machine C, by the switch guide valve 5. Therefore, the thousand-yen bills carried out from the reserve chamber Dr are taken into the money changing machine C.

During the bill change operation, the player will see the counter B adjacent to the left side of the money changing machine C. At that time, if another player counts a large number of discharged pachinko balls, the player using the money changing machine C feels as if he or she has a chance to win a large number of pachinko balls from every gaming machine in the gaming machine island. As a result, the chance that the player changing money may play a game at a gaming machine in the gaming machine island A is increased. Therefore, the embodiment enables efficient management in gaming machine island units containing money changing mechanism.

Figure 11:
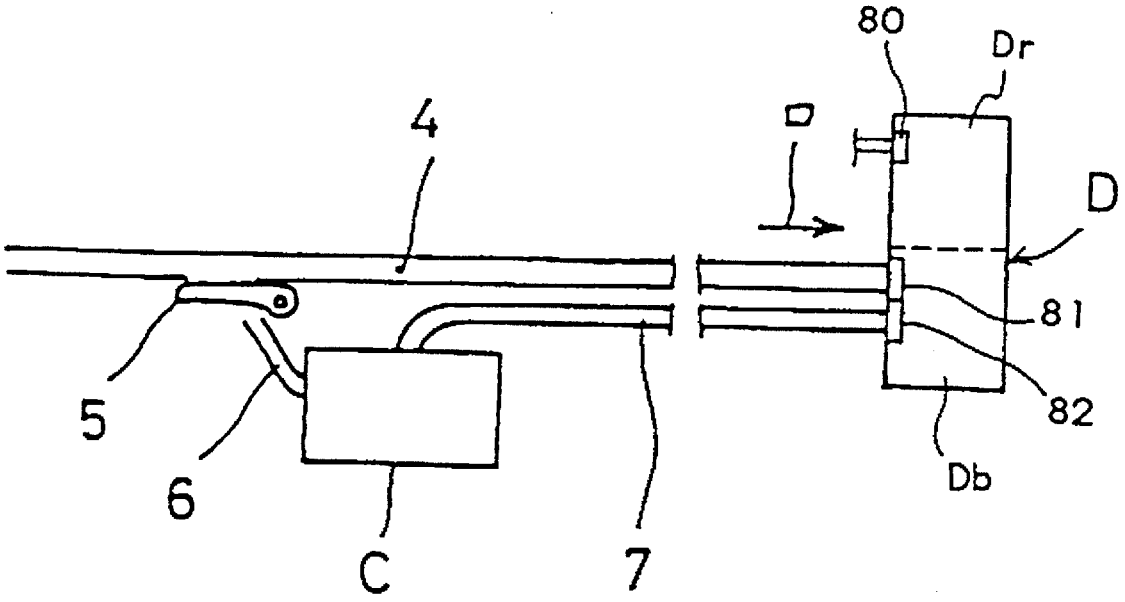
FIG. 11 is a plan view showing a second embodiment of the invention.
Figure 12:
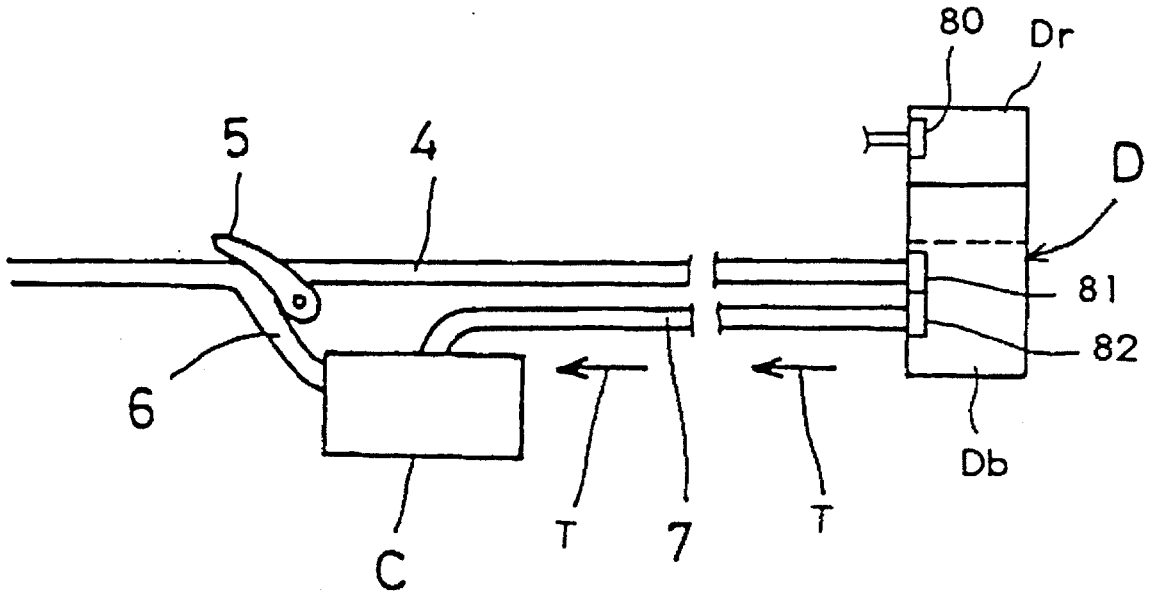
FIG. 12 is a plan view showing how thousand-yen bills are transported for replenishing a money changing machine C with thousand-yen bills from a collection chamber of a stacker D.

Next, a second embodiment of the invention will be discussed with reference to FIGS. 11 and 12. Parts identical with or similar to those previously described in the first embodiment are denoted by the same reference numerals in FIGS. 11 and 12 and will not be discussed again.

The second embodiment is characterized by a second bypass 7 for transporting thousand-yen bills 3 from a collection chamber Db of a stacker D to a money changing machine C. The structure of the second bypass 7 is basically similar to that of a carrying-out belt 17*b*, bill transport passages 4, etc., and therefore will not be discussed in detail again.

Further, each of a reserve chamber Dr and the collection chamber Db is provided with sensors 80, 81, and 82 for detecting bills coming and going. The sensor 80 detects a bill being carried out from the reserve chamber Dr. The sensor 81 detects a bill being carried in the collection chamber Db. The sensor 82 detects a bill being carried out from the collection chamber Db.

Figure 13:
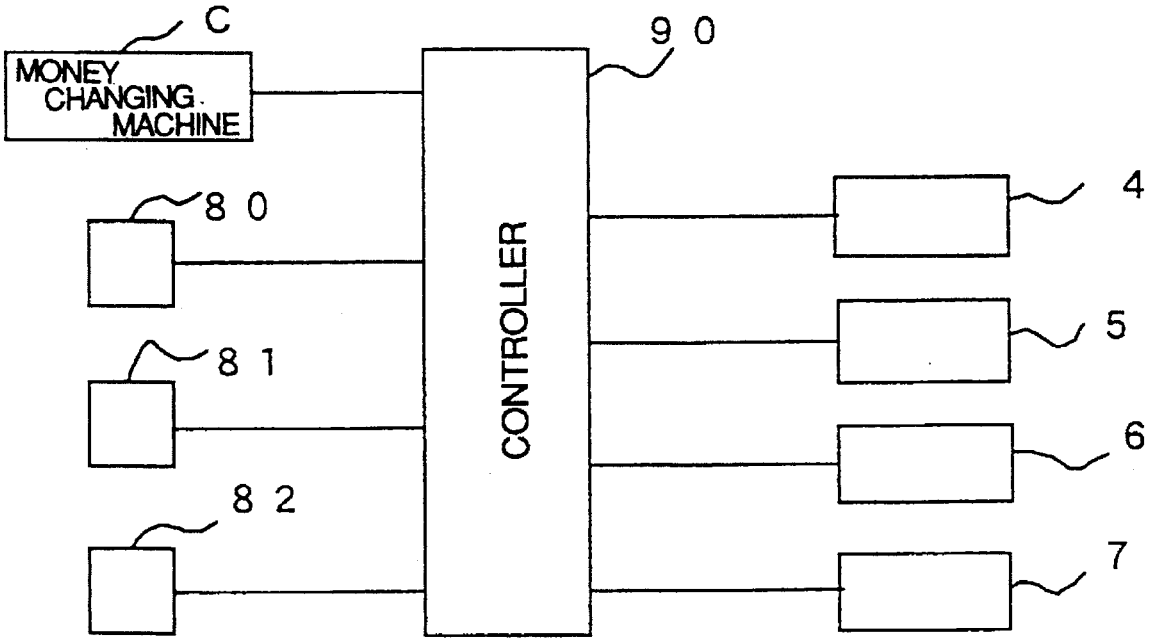
FIG. 13 is a block diagram showing the configuration of a control system.

Detection signals of the sensors 80, 81, and 82 are output to a controller 90 as shown in FIG. 13.

The controller 90 consists of hardware of a processor, memory, etc., and software stored in the memory. It monitors the comings and goings of bills based on the detection signals of the sensors 80, 81, and 82 for keeping track of the number of bills stored in each of the reserve chamber Dr and the collection chamber Db. Further, the controller 90 has a function of controlling the operation of the second bypass 7, bill transport passages 4, etc.

In the first embodiment, a controller similar to the controller 90 in the second embodiment is also provided for controlling the bill transport passages 4, relay transport passage 16, bypass 6, etc.

In the second embodiment, if thousand-yen bills for change provided in the reserve chamber Dr run out, the money changing machine C can be replenished with thousand-yen bills stored in the collection chamber Db through the second bypass 7. If the collection chamber Db fills with collected thousand-yen bills, the thousand-yen bills in the collection chamber Db are sent out to the money changing machine C taking precedence over bills in the reserve chamber Dr. A bill flow when the money changing machine C is replenished with bills is indicated by arrow T in FIG. 12.

The embodiment can lessen the condition where the reserve chamber Dr of the stacker D is low in thousand-yen bills or the collection chamber Db fills with thousand-yen bills, and can reduce the amount of labor required for maintenance of the money changing machines C, etc. The number of times personnel open the door of the stacker D or directly handle cash is reduced, leading to improvement in crime prevention, which provides a particularly large merit for pachinko ball parlors often open at night. Such an effect finally enables reduction of the number of employees in the parlor and therefore a large reduction of administration costs of the entire pachinko ball parlor. Further, the stop time of the money changing machines is shortened, leading to an improvement in service for players.

Although bill changing machines are taken as an example in the embodiments, the invention is not limited to them and can also be applied to money changing machines for changing coins into coins of a smaller denomination. The invention is also applicable to various gaming machines other than pachinko ball machines, needless to say. The "game play media" in the claims correspond to pachinko balls in the embodiments, but are not limited to pachinko balls and are a concept also including medals, etc., used with other gaming machines, such as slot machines. The invention can also be applied to a gaming machine island where gaming machines for players to directly input cash and play a game are arranged.

The "main transport passage" in the claims corresponds to the bill transport passages 4 in the embodiments, the "first branch transport passage" in the claims corresponds to the transport path part between the ball lending machine 2 and the bill transport passage 4, the "second branch transport passage" corresponds to the bypass 6, and the "third branch transport passage" corresponds to the second bypass 7. The "switch" corresponds to the switch guide valve 5.

We claim:

1. A gaming machine island comprising:

gaming machines at which players play games with game play media, and which pay out game play media to players as a prize;

a counter for counting the number of game play media that are deposited therein; and a money changing machine for changing a bill or coin into bills or coins of a smaller denomination, said money changing machine being placed adjoining said counter with respect to a transverse position.

2. The gaming machine island as claimed in claim 1 wherein said counter is installed substantially at the center of said gaming machine island.

3. The gaming machine island as claimed in claim 1 further including:

a storage section for storing bills or coins; and means for transporting the bills or coins between said storage section and said money changing machine.

4. The gaming machine island as claimed in claim 3 further including:

a game play media lending machine for receiving cash from players and lending game play media to them, said transport means also for transporting currency received at said game play media lending machine to said storage section.

5. The gaming machine island as claimed in claim 3 wherein said storage section is installed at an end position of said gaming machine island.

6. A money changing system attached to a gaming machine island comprising a plurality of gaming machines at which players play games with game play media and a counter for counting the number of game play media deposited therein, said money changing system comprising:

a stacker being placed at an end position of said gaming machine island for storing bills or coins;

a money changing machine having a transverse position with respect to and placed adjoining said counter, said money changing machine for changing a bill or coin into bills or coins of a smaller denomination; and means for transporting bills or coins between said money changing machine and said stacker.

7. A money changing system applied to a gaming machine island comprising a plurality of gaming machines at which players play games with game play media, a counter for counting the number of input game play media, and a game play media lending machine for lending the game play media to players in exchange for currency, said money changing system comprising:

a stacker being placed at an end position of said gaming machine island for storing bills or coins;

a money changing machine having a transverse position placed adjoining said counter for changing a bill or coin into bills or coins of a smaller denomination; and a transporter for transporting bills or coins, said transporter comprising:

a main transport passage formed like a loop with said stacker as start and end points;

a first branch transport passage formed between said game play media lending machine and a midway point of said main transport passage;

a second branch transport passage formed between a midway point of said main transport passage and said money changing machine; and a switch for switching a currency transport path at a branch point between said second branch transport passage and said main transport passage.

8. The money changing system as claimed in claim 7 wherein said stacker comprises:

a reserve chamber for storing reserved bills or coins; and a collection chamber for storing bills or coins carried by said transporter, said transporter for transporting the bills or coins in said reserve chamber to said money changing machine and also for transporting bills or coins input to said game play media lending machine to said collection chamber.

9. The money changing system as claimed in claim 8 wherein said transporter further includes a third branch transport passage for transporting the bills or coins stored in said collection chamber to said money changing machine.

* * * * *